US010704792B2

(12) United States Patent
Lee

(10) Patent No.: US 10,704,792 B2
(45) Date of Patent: Jul. 7, 2020

(54) ADSORPTIVE HYBRID DESICCANT COOLING SYSTEM

(71) Applicant: KOREA INSTITUTE OF SCIENCE AND TECHNOLOGY, Seoul (KR)

(72) Inventor: Dae Young Lee, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 215 days.

(21) Appl. No.: 15/841,932

(22) Filed: Dec. 14, 2017

(65) Prior Publication Data

US 2018/0299147 A1 Oct. 18, 2018

(30) Foreign Application Priority Data

Apr. 12, 2017 (KR) ..... 10-2017-0047587

(51) Int. Cl.
*F24F 3/14* (2006.01)
*F24F 5/00* (2006.01)

(52) U.S. Cl.
CPC ..... *F24F 3/1423* (2013.01); *F24F 5/0014* (2013.01); *F24F 2003/1458* (2013.01); *F24F 2203/026* (2013.01); *F24F 2203/1032* (2013.01)

(58) Field of Classification Search
CPC ..... F24F 3/1423; F24F 3/1429; F24F 3/02; F24F 5/0014; F24F 2003/1458; F24F 2203/026; F24F 2203/1032; F25B 17/083; F25B 17/086; F25B 17/00; F25B 29/006
See application file for complete search history.

(56) References Cited

U.S. PATENT DOCUMENTS 5,943,874 A 8/1999 Maeda
2005/0262720 A1* 12/2005 Rane ..... B01D 53/263 34/330
2010/0212345 A1 8/2010 Yoon et al.
2016/0313034 A1* 10/2016 Takeuchi ..... F25B 17/083

FOREIGN PATENT DOCUMENTS

JP 10-096542 A 4/1998
KR 10-0773434 B1 11/2007

OTHER PUBLICATIONS

Korean Office Action dated May 15, 2018.

* cited by examiner

*Primary Examiner* — Joseph F Trpisovsky
(74) *Attorney, Agent, or Firm* — Rabin & Berdo, P.C.

(57) ABSTRACT

Provided is an adsorptive hybrid desiccant cooling system, including a desiccant cooler comprising a housing including a regeneration passage and a dehumidification passage, a desiccant rotor mounted on a partition wall dividing the regeneration passage and the dehumidification passage from each other, a regeneration preheater installed upstream of the desiccant rotor in the dehumidification passage, and a cooler installed downstream of the desiccant rotor in the dehumidification passage; and an adsorptive cooler comprising an adsorber including a first sub-adsorber and a second sub-adsorber configured to adsorb a refrigerant at an adsorption temperature and desorb the refrigerant at a regeneration temperature, a condenser configured to condense the refrigerant, and an evaporator configured to evaporate the refrigerant, wherein the adsorber is connected to each of the external heat source and the regeneration preheater, and the regeneration preheater is heated by adsorption heat generated in the adsorber.

18 Claims, 3 Drawing Sheets

ADSORPTIVE HYBRID DESICCANT COOLING SYSTEM

CROSS-REFERENCE TO RELATED APPLICATION

This application claims the benefit of Korean Patent Application No. 10-2017-0047587, filed on Apr. 12, 2017, in the Korean Intellectual Property Office, the disclosure of which is incorporated herein in its entirety by reference.

BACKGROUND

1. Field

One or more embodiments relate to an adsorptive hybrid desiccant cooling system, and more particularly, to an adsorptive hybrid desiccant cooling system capable of remarkably reducing power consumption.

2. Description of the Related Art

Electric hybrid desiccant cooling technology improves cooling output by adding an electric heat pump to a desiccant cooling system, and enhances energy efficiency by using less regeneration heat by using the arrangement of the heat pump in preheating the regeneration air of the desiccant cooling system. However, as more power is used by a compressor for driving the electric heat pump, total power consumption may actually increase compared to basic desiccant air-conditioning.

The background art described above is a technique that the inventor had to derive embodiments of the present disclosure or technical information acquired during the process of deriving the same, and is not necessarily a technique known to the general public prior to the filing of the embodiments of the present disclosure.

SUMMARY

One or more embodiments include an adsorptive hybrid desiccant cooling system in which an adsorptive cooler driven using an external heat source is added to thereby remarkably reduce power consumption, and total energy efficiency may also be significantly increased. However, the above objectives of the present disclosure are exemplary, and the scope of the embodiments of the present disclosure is not limited by the above objectives.

Additional aspects will be set forth in part in the description which follows and, in part, will be apparent from the description, or may be learned by practice of the presented embodiments.

According to one or more embodiments, an adsorptive hybrid desiccant cooling system that includes an adsorptive cooler producing cool air by using an external heat source includes: a desiccant cooler including a housing including a regeneration passage and a dehumidification passage through which the air passes, a desiccant rotor installed inside the housing to be rotatable about a rotary shaft mounted on a partition wall dividing the regeneration passage and the dehumidification passage from each other, a regeneration preheater installed upstream of the desiccant rotor in the regeneration passage, and a cooler installed downstream of the desiccant rotor in the dehumidification passage; and the adsorptive cooler including an adsorber including a first sub-adsorber and a second sub-adsorber configured to adsorb a refrigerant at an adsorption temperature and desorb the refrigerant at a regeneration temperature, a condenser configured to condense the refrigerant that is desorbed from the adsorber and is in a gaseous state so as to provide heating by using condensation heat, and an evaporator configured to evaporate the refrigerant and transfer the refrigerant in a gaseous state to the adsorber and produce cool air by using evaporation heat, wherein the adsorber is connected to each of the external heat source and the regeneration preheater, and wherein the regeneration preheater is heated by adsorption heat generated in the adsorber.

The adsorptive hybrid desiccant cooling system may further include a heating coil between the regeneration preheater and the desiccant rotor in the regeneration passage, the heating coil being heated by the external heat source having a temperature decreased by passing through the adsorber.

The air introduced into the regeneration passage may be heated by sequentially passing through the regeneration preheater and the heating coil, and the heated air may regenerate the desiccant rotor passing through the regeneration passage.

The air introduced into the dehumidification passage may be dehumidified by passing through the desiccant rotor passing through the dehumidification passage, and the dehumidified air may be cooled by passing through the cooler.

The desiccant cooler may further include a re-cooler that is connected to the evaporator of the adsorptive cooler and installed downstream of the cooler in the dehumidification passage to re-cool the air that is cooled by passing through the cooler.

The cooler may include a regenerative evaporative cooler.

The adsorptive cooler may further include a refrigerant pipe respectively connecting the first sub-adsorber and the second sub-adsorber to the condenser and the evaporator, wherein the refrigerant pipe may connect the condenser to the evaporator, and a refrigerant flowing in the refrigerant pipe may sequentially circulate through the first sub-adsorber, the condenser, the evaporator, and the second sub-adsorber, or through the second sub-adsorber, the condenser, the evaporator, and the first sub-adsorber.

The adsorptive cooler may further include: a first refrigerant valve installed in the refrigerant pipe connecting the first sub-adsorber to the condenser and the evaporator; a second refrigerant valve installed in the refrigerant pipe connecting the second sub-adsorber to the condenser and the evaporator; and a third refrigerant valve installed in the refrigerant pipe connecting the condenser and the evaporator.

The adsorptive cooler may further include: a first heat transfer medium pipe connecting the regeneration preheater to the first sub-adsorber and the second sub-adsorber; and a second heat transfer medium pipe connecting the external heat source to the first sub-adsorber and the second sub-adsorber.

The adsorptive cooler may further include: a 1-1 heat transfer medium valve that is installed at an upstream end of the first sub-adsorber at the heat transfer medium pipe so as to connect one of the external heat source and the regeneration preheater to the upstream end of the first sub-adsorber at the heat transfer medium pipe; a 1-2 heat transfer medium pipe that is installed at a downstream end of the first sub-adsorber at the heat transfer medium pipe so as to connect the downstream end of the first sub-adsorber at the heat transfer medium pipe to one of the external heat source and the regeneration preheater; a 2-1 heat transfer medium valve that is installed at an upstream end of the second sub-adsorber at the heat transfer medium pipe so as to connect one of the external heat source and the regeneration preheater to the upstream end of the second sub-adsorber at the heat transfer medium pipe; and a 2-2 heat transfer medium valve that is installed at a downstream end of the second sub-adsorber at the heat transfer medium pipe so as to connect the downstream end of the second sub-adsorber at the heat transfer medium pipe to one of the external heat source and the regeneration preheater.

The 1-1 heat transfer medium valve may be installed at the upstream end of the first sub-adsorber at the heat transfer medium pipe, where the first heat transfer medium pipe and the second heat transfer medium pipe intersect with each other, the 1-2 heat transfer medium valve may be installed at the downstream end of the first sub-adsorber at the heat transfer medium pipe, where the first heat transfer medium pipe and the second heat transfer medium pipe are divided from each other, the 2-1 heat transfer medium valve may be installed at the upstream end of the second sub-adsorber at the heat transfer medium pipe, where the first heat transfer medium pipe and the second heat transfer medium pipe intersect with each other, and the 2-2 heat transfer medium valve may be installed at the downstream end of the second sub-adsorber at the heat transfer medium pipe, where the first heat transfer medium pipe and the second heat transfer medium pipe are divided from each other.

When the 1-1 heat transfer medium valve connects the upstream end of the first sub-adsorber at the heat transfer medium pipe to the regeneration preheater, the 1-2 heat transfer medium valve may connect the downstream end of the first sub-adsorber at the heat transfer medium pipe to the regeneration preheater, the 2-1 heat transfer medium valve may connect the upstream end of the second sub-adsorber at the heat transfer medium pipe to the external heat source, and the 2-2 heat transfer medium valve may connect the downstream end of the second sub-adsorber at the heat transfer medium pipe to the external heat source.

The first sub-adsorber may be connected to the evaporator to receive the refrigerant evaporated in the evaporator to adsorb the refrigerant, and the second sub-adsorber may be connected to the condenser to transfer the refrigerant desorbed from the second sub-adsorber to the condenser.

When the 1-1 heat transfer medium valve connects the upstream end of the first sub-adsorber at the heat transfer medium pipe to the external heat source, the 1-2 heat transfer medium valve may connect the downstream end of the first sub-adsorber at the heat transfer medium pipe to the external heat source, the 2-1 heat transfer medium valve may connect the upstream end of the second sub-adsorber at the heat transfer medium pipe to the regeneration preheater, and the 2-2 heat transfer medium valve may connect the downstream end of the second sub-adsorber at the heat transfer medium pipe to the regeneration preheater.

An end of the first sub-adsorber at the refrigerant pipe may be connected to the condenser to transfer the refrigerant desorbed from the first sub-adsorber to the condenser, and an end of the second sub-adsorber at the refrigerant pipe may be connected to the evaporator to receive the refrigerant evaporated in the evaporator to adsorb the refrigerant.

The adsorptive cooler may further include a third heat transfer medium valve that is installed at a downstream end of the first sub-adsorber and the second sub-adsorber at the heat transfer medium pipe so as to connect the downstream end of the first sub-adsorber and the second sub-adsorber at the heat transfer medium pipe to one of the external heat source and the heating coil.

The adsorptive cooler may further include a first pump installed between the external heat source and the adsorber to guide the external heat source to the adsorber.

The adsorptive cooler may further include a second pump installed between the regeneration preheater and the adsorber to guide a heat transfer medium of the regeneration preheater to the adsorber.

In addition to the aforesaid details, other aspects, features, and advantages will be clarified from the following drawings, claims, and detailed description.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
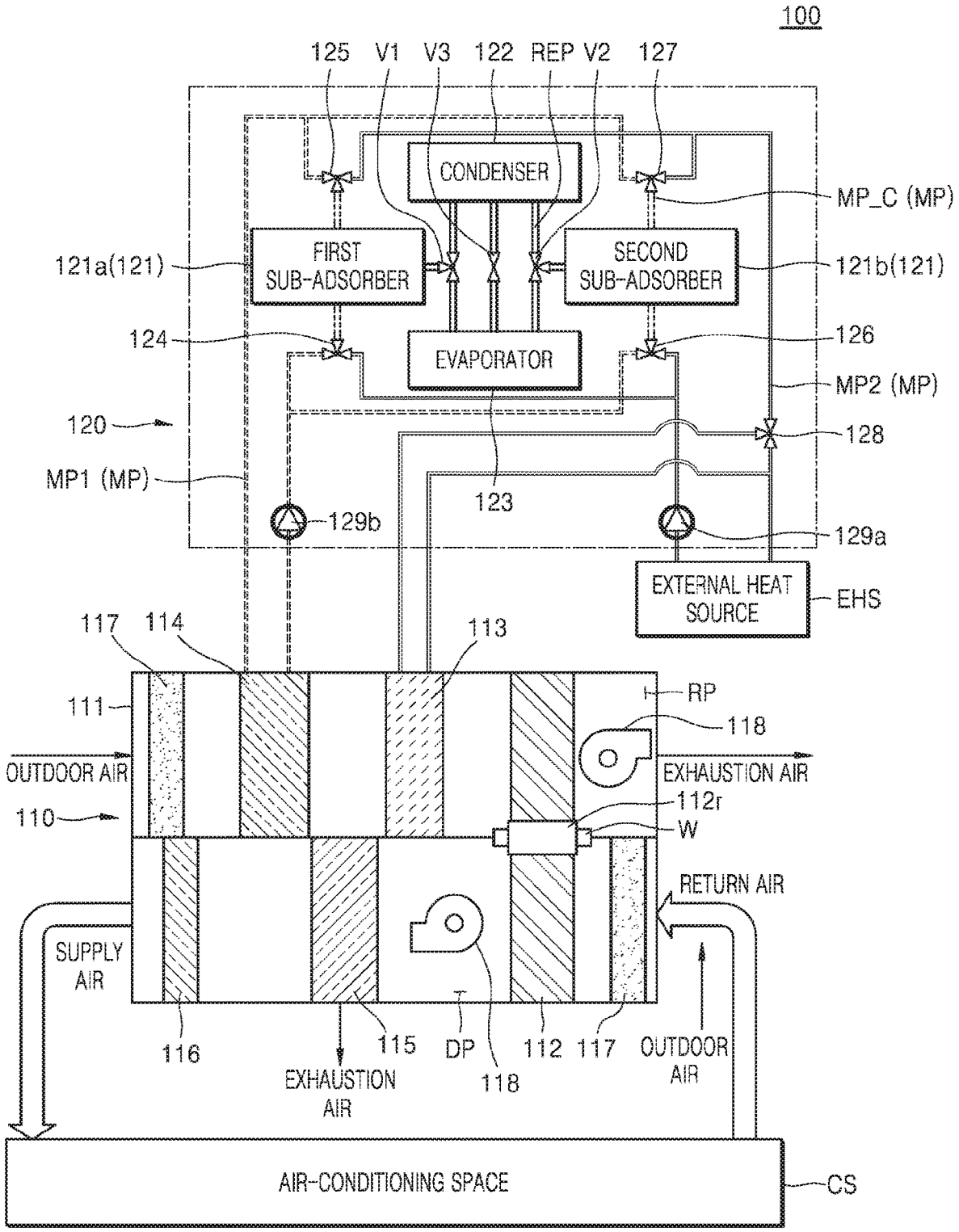
FIG. 1 is a schematic perspective view of a structure of an adsorptive hybrid desiccant cooling system according to an embodiment of the present disclosure.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

Since the present disclosure may have various modifications and several embodiments, exemplary embodiments are shown in the drawings and will be described in detail. Advantages, features, and a method of achieving the same will be specified with reference to the embodiments described below in detail together with the attached drawings. However, the embodiments may have different forms and should not be construed as being limited to the descriptions set forth herein.

An expression used in the singular form encompasses the expression in the plural form, unless it has a clearly different meaning in the context. In the present specification, it is to be understood that the terms such as "including" or "having", etc., are intended to indicate the existence of the features or components disclosed in the specification, and are not intended to preclude the possibility that one or more other features or components may added.

It will be understood that, although the terms first, second, etc. may be used herein to describe various elements, these elements should not be limited by these terms. These terms are only used to distinguish one element from another.

Also, in the drawings, for convenience of description, sizes of elements may be exaggerated or contracted. In other words, since sizes and thicknesses of components in the drawings are arbitrarily illustrated for convenience of explanation, the following embodiments are not limited thereto.

The embodiments of the present disclosure will be described below in more detail with reference to the accompanying drawings. Those components that are the same or are in correspondence are rendered the same reference numeral regardless of the figure number, and redundant explanations are omitted.

Figure 2:
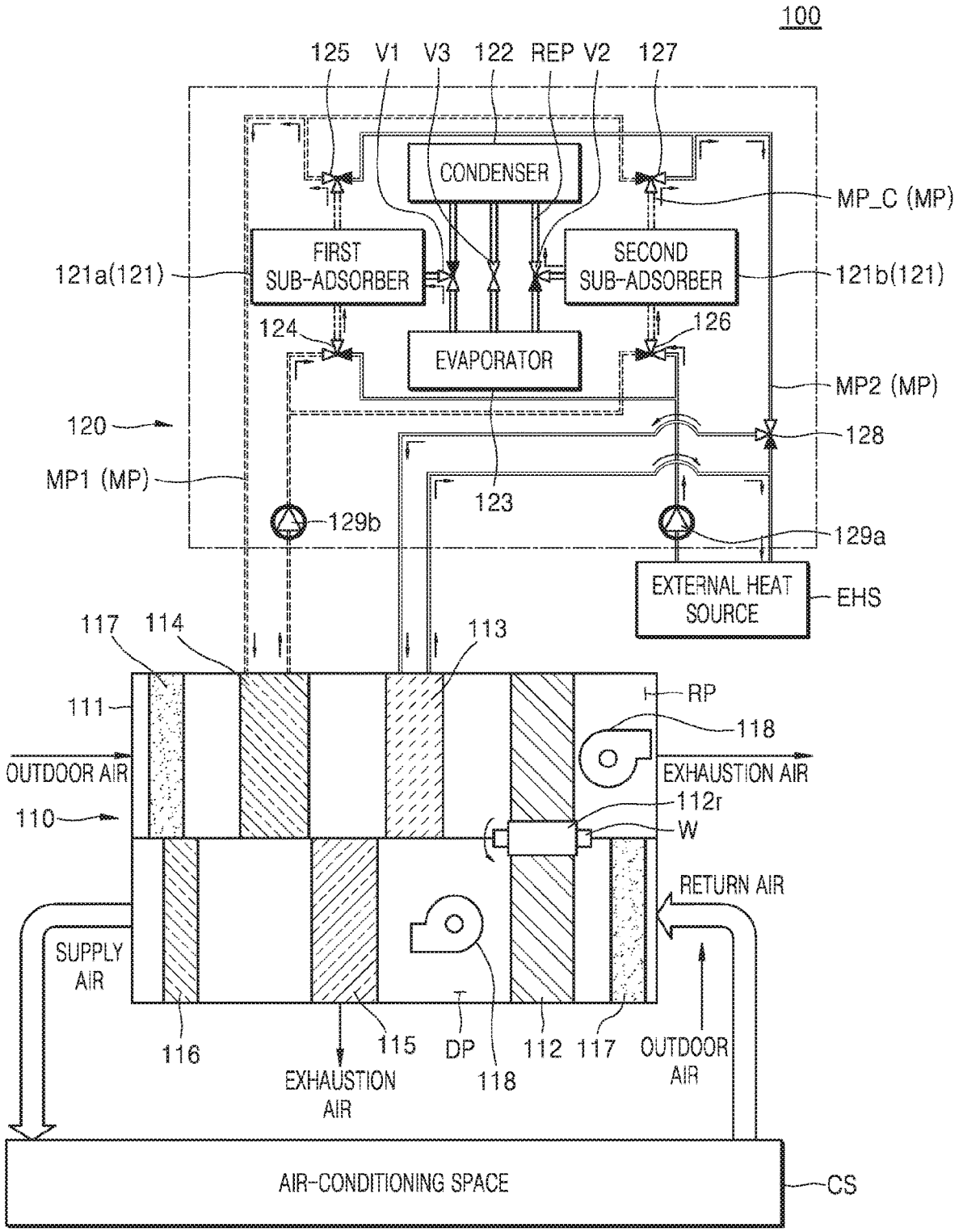
FIG. 2 is a schematic conceptual diagram of a first operational example of the adsorptive hybrid desiccant cooling system illustrated in FIG. 1.
Figure 3:
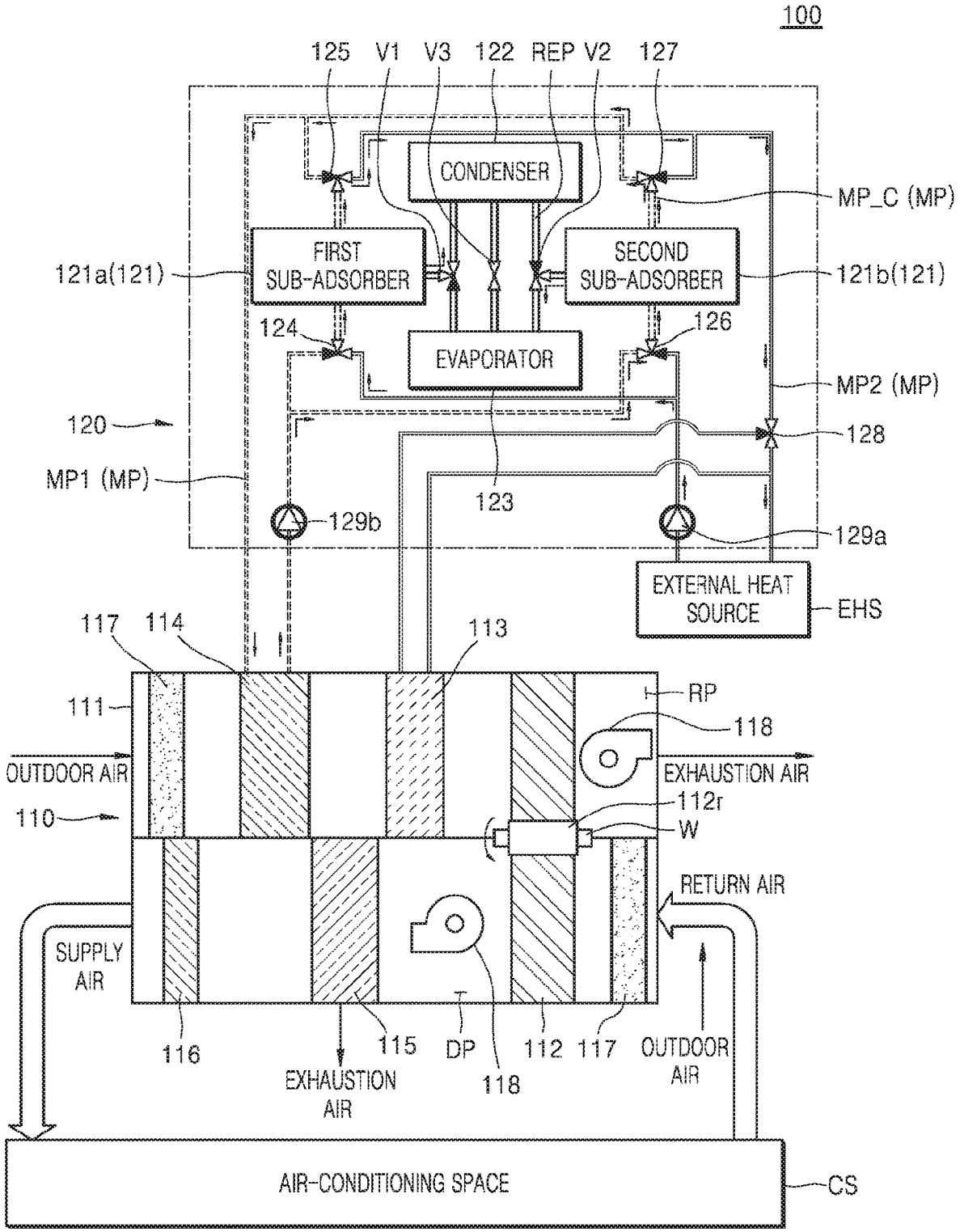
FIG. 3 is a schematic conceptual diagram of a second operational example of the adsorptive hybrid desiccant cooling system illustrated in FIG. 1.

FIG. 1 is a schematic perspective view of a structure of an adsorptive hybrid desiccant cooling system 100 according to an embodiment of the present disclosure. FIG. 2 is a schematic conceptual diagram of a first operational example of the adsorptive hybrid desiccant cooling system 100 illustrated in FIG. 1. FIG. 3 is a schematic conceptual diagram of a second operational example of the adsorptive hybrid desiccant cooling system 100 illustrated in FIG. 1.

Referring to FIG. 1, the adsorptive hybrid desiccant cooling system 100 may include a desiccant cooler 110 and an adsorptive cooler 120.

The desiccant cooler 110 may include a housing 111, a desiccant rotor 112, a heating coil 113, a regeneration preheater 114, a cooler 115, a re-cooler 116, a filter 117, and a fan 118.

The housing 111 includes a regeneration passage RP and a dehumidification passage DP through which the air passes and provides an internal space in which other elements of the desiccant cooler 110 are installed, and may function as a case. In addition, although not illustrated in the drawings, the housing 111 may accommodate not only the elements of the desiccant cooler 110 but also elements of the adsorptive cooler 120, as described below.

For convenience of description, the elements of the desiccant cooler 110 and the adsorptive cooler 120 are respectively illustrated as blocks. However, the embodiments of the present disclosure are not limited to the structure of the housing 111 illustrated in the drawings. The housing 111, for example, may accommodate both the desiccant cooler 110 and the adsorptive cooler 120. As shown in the drawings, the elements of the adsorptive cooler 120 may be disposed in a separate space provided inside the housing 111, different from the regeneration passage RP and the dehumidification passage DP of the housing 111.

Although not shown in the drawings, the regeneration passage RP and the dehumidification passage DP of the housing 111 may each include an inlet (not shown) and an outlet (not shown) through which the air is introduced and discharged. For example, in the case of the regeneration passage RP, an inlet may be provided at one side of the regeneration passage RP into which outdoor air flows, and an outlet may be formed at the other side of the regeneration passage RP through which the air is exhausted. In the case of the dehumidification passage DP, an inlet may be formed at one side of the dehumidification passage DP into which return air from the air-conditioning space CS and outdoor air flow, an outlet may be formed at the other side of the dehumidification passage DP through which the air is supplied into the air-conditioning space CS.

A partition wall W dividing the regeneration passage RP and the dehumidification passage DP from each other may be provided inside the housing 111. The partition wall W may fluidically block the regeneration passage RP and the dehumidification passage DP such that the airs each flowing inside the regeneration passage RP and the dehumidification passage DP are not mixed with each other.

The desiccant rotor 112 may be installed inside the housing 111 and be rotatable about a rotary shaft 112*r* mounted on the partition wall W. In detail, the desiccant rotor 112 may have a honeycomb-like porous structure that is preferably formed of ceramic paper, and a dehumidifying agent such as silica gel may be stably coated on a surface of the ceramic paper.

A first portion of the desiccant rotor 112 may pass through the regeneration passage RP while rotating about the rotary shaft 112*r*. A second portion of the desiccant rotor 112 except for the above the first portion may pass through the dehumidification passage DP. Here, moisture adsorbed to the desiccant rotor 112 may be desorbed from the above the first portion of the desiccant rotor 112 passing through the regeneration passage RP so that the first portion of the desiccant rotor 112 may be regenerated to adsorb moisture again if the desiccant rotor 112 enters the dehumidification passage DP again later. The second portion of the desiccant rotor 112 passing through the dehumidification passage DP (the remaining portion excluding the above the first portion of the desiccant rotor 112 passing through the regeneration passage DP) may adsorb moisture in the air flowing in the dehumidification passage DP.

As a position of regeneration and adsorption is continuously varied during rotation of the desiccant rotor 112, in the regeneration passage RP and the dehumidification passage DP, regeneration and adsorption of the desiccant rotor 112 may be continuously performed without stopping the desiccant rotor 112.

The heating coil 113 may be installed in the regeneration passage RP, between the desiccant rotor 112 and the regeneration preheater 114. As described below, the heating coil 113 may be heated by an external heat source EHS whose temperature decreases by passing through an adsorber 121, and may heat the air that passes through the heating coil 113. The heat exchange between the external heat source EHS and the heating coil 113 will be described in detail below with reference to description of the adsorptive cooler 120.

The regeneration preheater 114 may be installed upstream of the desiccant rotor 112, in detail, upstream of the heating coil 113. As described below, the regeneration preheater 114 may be connected to the adsorber 121 of the adsorptive cooler 120 to be heated by adsorption heat generated in the adsorber 121, and may heat the air that passes through the regeneration preheater 114. The heat exchange between the adsorber 121 and the regeneration preheater 114 will be described in detail below with reference to the adsorptive cooler 120.

The air introduced into the regeneration passage RP may sequentially pass through the regeneration preheater 114 and the heating coil 113 to be heated. For example, temperatures of the regeneration preheater 114 and the heating coil 113 installed in the regeneration passage RP may be respectively maintained at about 30° C. and about 70° C. so as to sequentially heat the air passing through the regeneration preheater 114 and the heating coil 113. The air heated by passing through the regeneration preheater 114 and the heating coil 113 may heat a portion of the desiccant rotor 112 passing through the regeneration passage RP to thereby evaporate the moisture adsorbed to the desiccant rotor 112 and regenerate the desiccant rotor 112.

The cooler 115 may be installed downstream of the desiccant rotor 112 passing through the dehumidification passage DP. According to this structure, the air introduced into the dehumidification passage DP passes through the dehumidification passage DP to be dehumidified, and the dehumidified air may be cooled by passing through the cooler 115.

In detail, the cooler 115 may include a regenerative evaporative cooler. The regenerative evaporative cooler includes a dry channel through which hot and dry air that has passed through the desiccant rotor 112 passes, and a wet channel that is different from the dry channel, wherein a portion of the air that has passed through the dry channel is returned to the wet channel, and water is evaporated in the wet channel through which the hot and dry air passes, so as to cool the air passing through the dry channel, by using latent heat of evaporation. That is, the hot and dry air introduced into the cooler 115 is cooled while passing through the dry channel, and then flows to the re-cooler 116, as described below, and the air that has returned to the wet channel may be discharged to the outside in a humidified state.

The re-cooler 116 may be connected to an evaporator 123 of the adsorptive cooler 120, as described below, and may be disposed downstream of the cooler 115 in the dehumidification passage DP to re-cool the air that is cooled by passing through the cooler 115. The air cooled by the re-cooler 116 is supplied to the air-conditioning space CS through the outlet of the dehumidification passage DP, thereby supplying cool air into the air-conditioning space CS.

The filter 117 may be installed in an uppermost portion of the regeneration passage RP through which the outdoor air flows and in an uppermost portion of the dehumidification passage DP into which the returning air and the outdoor air flow, and may be used to filter foreign substances or bacteria in the air flowing into the dehumidification passage DP.

The fan 118 may be installed downstream of the desiccant rotor 112 passing through the regeneration passage RP and downstream of the desiccant rotor 112 passing through the dehumidification passage DP, and may forcibly guide the air flowing into the regeneration passage RP and the dehumidification passage DP toward the outlet.

Next, the adsorptive cooler 120 may include an adsorber 121, a condenser 122, and the evaporator 123.

The adsorber 121 may include a first sub-adsorber 121*a* and a second sub-adsorber 121*b* that adsorb a refrigerant at an adsorption temperature and desorb the refrigerant at a regeneration temperature. For example, the adsorption temperature may preferably be about 30° C. to about 50° C., and the regeneration temperature may preferably be about 70° C. to 90° C.

The first sub-adsorber 121*a* and the second sub-adsorber 121*b* may respectively perform an adsorption mode for adsorbing a refrigerant and a desorption mode for desorbing a refrigerant. That is, when the first sub-adsorber 121*a* performs an adsorption mode, the second sub-adsorber 121*b* may perform a desorption mode. On the contrary, when the first sub-adsorber 121*a* performs a desorption mode, the second sub-adsorber 121*b* may perform an adsorption mode.

An end of the adsorber 121 at a heat transfer medium pipe MP may be connected to the external heat source EHS and the regeneration preheater 114, respectively. That is, ends of the first sub-adsorber 121*a* and the second sub-adsorber 121*b* at the heat transfer medium pipe MP may be alternately connected to the external heat source EHS and the regeneration preheater 114, respectively. As operations of the first sub-adsorber 121*a* and the second sub-adsorber 121*b* are related to interaction between the condenser 122 and the evaporator 123 and the external heat source EHS and the regeneration preheater 114, as described below, the operations of the first sub-adsorber 121*a* and the second sub-adsorber 121*b* will be described in more detail after describing the condenser 122 and the evaporator 123 below.

The condenser 122 may condense a refrigerant that is desorbed from the adsorber 121 and is in a gaseous state and produce heat using condensation heat. In detail, the condenser 122 may receive the desorbed refrigerant in a gaseous state from the adsorber 121 that operates in a desorption mode, from among the first sub-adsorber 121*a* and the second sub-adsorber 121*b* (that is, one of the first sub-adsorber 121*a* and the second sub-adsorber 121*b*), and the gaseous refrigerant transferred to the condenser 122 may be condensed in the condenser 122. As the gaseous refrigerant is condensed in the condenser 122, the condensation heat may be transferred to cooling water flowing through a cooling water pipe (not shown) installed to pass through the condenser 122.

The evaporator 123 may evaporate the refrigerant to transfer the refrigerant in a gaseous state to the adsorber 121, and may provide cool air by using the evaporation heat. In detail, the evaporator 123 may transfer the refrigerant in a gaseous state to the adsorber 121 operating in an adsorption mode, from among the first sub-adsorber 121*a* and the second sub-adsorber 121*b* (that is, one of the first sub-adsorber 121*a* and the second sub-adsorber 121*b*), and the gaseous refrigerant transferred to the adsorber 121 may be adsorbed by the adsorber 121. Evaporation heat needed for the refrigerant to be evaporated in the evaporator 123 may be supplied by cool water flowing through the cooling water pipe (not shown) installed to pass through the evaporator 123. Although not shown in the drawing, the cool water cooled in the evaporator 123 may be transferred to the re-cooler 116 of the desiccant cooler 110 through the cool water pipe, and may be used to supply cool air to the air-conditioning space CS.

Meanwhile, as shown in the drawing, the condenser 122 and the evaporator 123 are respectively connected to the first sub-adsorber 121*a* and the second sub-adsorber 121*b* through a refrigerant pipe REP. A first refrigerant valve V1 and a second refrigerant valve V2 may be installed in the refrigerant pipe REP at the first sub-adsorber 121*a* and the second sub-adsorber 121*b*, respectively, and the first sub-adsorber 121*a* and the second sub-adsorber may be respectively connected to the condenser 122 or the evaporator 123 through the first refrigerant valve V1 and the second refrigerant valve V2.

Although not shown in the drawing, the first refrigerant valve V1 and the second refrigerant valve V2 may be disposed between the first sub-adsorber 121*a* and the condenser 122, between the first sub-adsorber 121*a* and the evaporator 123, between the second sub-adsorber 121*b* and the condenser 122, and between the second sub-adsorber 121*b* and the evaporator 123. However, as shown in the drawing, description below will focus on an embodiment in which the first refrigerant valve V1 is a type of three-way valve connecting the first sub-adsorber 121*a* to the condenser 122 and the evaporator 123, and the second refrigerant valve V2 is a three-way valve connecting the second sub-adsorber 121*b* to the condenser 122 and the evaporator 123.

The condenser 122 and the evaporator 123 may also be connected to each other through the refrigerant pipe REP, and in the refrigerant pipe REP connecting the condenser 122 and the evaporator 123, a third refrigerant valve V3 through which a liquid refrigerant condensed in the condenser 122 is transferred to the evaporator 123 may be installed.

In detail, when the first sub-adsorber 121*a* and the second sub-adsorber 121*b* respectively perform a adsorption mode and a desorption mode, a liquid refrigerant is continuously generated in the condenser 122, whereas the liquid refrigerant stored in the evaporator 123 is evaporated and continuously transferred to the first sub-adsorber 121*a* or the second sub-adsorber 121*b* which performs an adsorption mode.

As a result, since the liquid refrigerant continuously decreases in the evaporator 123, it is necessary to continuously replenish the liquid refrigerant. Accordingly, the liquid refrigerant that is continuously generated in the condenser 122 may be continuously supplied to the evaporator 123 by opening the third refrigerant valve V3, and in this manner, a system may be configured such that the refrigerant sequentially circulates through the first sub-adsorber 121*a* (or the second sub-adsorber 121*b*), the condenser 122, the evaporator 123, and the second sub-adsorber 121*b* (or the first sub-adsorber 121*a*).

Meanwhile, the desiccant cooler 110 and the adsorptive cooler 120 may be connected to each other through the heat transfer medium pipe MP. In detail, the heat transfer medium pipe MP may connect the heating coil 113 and the regeneration preheater 114 of the desiccant cooler 110 and the external heat source EHS to the first sub-adsorber 121*a* and the second sub-adsorber 121*b*.

The adsorptive cooler 120 may include a 1-1 heat transfer medium valve 124 that is installed at an upstream end of the heat transfer medium pipe MP connected to the first sub-adsorber 121*a* so as to connect one of the external heat source EHS and the regeneration preheater 114 to an upstream end of the first sub-adsorber 121*a* at the heat transfer medium pipe MP; a 1-2 heat transfer medium pipe 125 that is installed at a downstream end of the first sub-adsorber 121*a* at the heat transfer medium pipe MP so as to connect a downstream end of the first sub-adsorber 121*a* at the heat transfer medium pipe MP to one of the external heat source EHS and the regeneration preheater 114; a 2-1 heat transfer medium valve 126 that is installed at an upstream end of the second sub-adsorber 121*b* at the heat transfer medium pipe MP so as to connect one of the external heat source EHS and the regeneration preheater 114 to an upstream end of the second sub-adsorber 121*b* at the heat transfer medium pipe MP; a 2-2 heat transfer medium valve 127 that is installed at a downstream end of the second sub-adsorber 121*b* at the heat transfer medium pipe MP so as to connect a downstream end of the second sub-adsorber 121*b* at the heat transfer medium pipe MP to one of the external heat source EHS and the regeneration preheater 114; and a third heat transfer medium valve 128 that is installed at a downstream end of the first sub-adsorber 121*a* and the second sub-adsorber 121*b* at the heat transfer medium pipe MP so as to connect a downstream end of the first sub-adsorber 121*a* and the second sub-adsorber 121*b* at the heat transfer medium pipe MP to one of the external heat source EHS and the heating coil 113.

In detail, the heat transfer medium pipe MP may include a first heat transfer medium pipe MP1 connecting the regeneration preheater 114 of the desiccant cooler 110, the first sub-adsorber 121*a*, and the second sub-adsorber 121*b* to one another and a second heat transfer medium pipe MP2 connecting the external heat source EHS to the first sub-adsorber 121*a*, the second sub-adsorber 121*b* and the heating coil 113.

That is, the 1-1 heat transfer medium valve 124 may be installed at an upstream end of the first sub-adsorber 121*a* at the heat transfer medium pipe MP, where the first heat transfer medium pipe MP1 and the second heat transfer medium pipe MP2 intersect with each other, and the 1-1 heat transfer medium valve 124 and the first sub-adsorber 121*a* may be connected to each other through a common pipe MP_C. Similarly, the 1-2 heat transfer medium valve 125, the 2-1 heat transfer medium valve 126, and the 2-2 heat transfer medium valve 127 may also be installed at an upstream or downstream end of the first sub-adsorber 121*a* and the second sub-adsorber 121*b* at the heat transfer medium pipe MP, where the first heat transfer medium pipe MP1 and the second heat transfer medium pipe MP2 intersect with each other or are divided from each other, and the 1-2 heat transfer medium valve 125, the 2-1 heat transfer medium valve 126, and the 2-2 heat transfer medium valve 127 may be connected to each other through the first sub-adsorber 121*a* or the second sub-adsorber 121*b* and the common pipe MP_C.

The adsorptive cooler 120 may further include a first pump 129*a* disposed between the external heat source EHS and the adsorber 121 to guide the external heat source EHS to the adsorber 121. In addition, the adsorptive cooler 120 may further include a second pump 129*b* disposed between the regeneration preheater 114 and the adsorber 121 to guide a heat transfer medium of the regeneration preheater 114 to the adsorber 121.

According to an embodiment, when the 1-1 heat transfer medium valve 124 connects the upstream end of the first sub-adsorber 121*a* at the heat transfer medium pipe MP to the regeneration preheater 114 (see FIG. 2), the 1-2 heat transfer medium valve 125 may connect the downstream end of the first sub-adsorber 121*a* at the heat transfer medium pipe MP to the regeneration preheater 114, the 2-1 heat transfer medium valve 126 may connect the upstream end of the second sub-adsorber 121*b* at the heat transfer medium pipe MP to the external heat source EHS, and the 2-2 heat transfer medium valve 127 may connect the downstream end of the second sub-adsorber 121*b* at the heat transfer medium pipe MP to the external heat source EHS.

When the regeneration preheater 114 is connected to the first sub-adsorber 121*a* and the external heat source EHS is connected to the second sub-adsorber 121*b*, as illustrated in FIG. 2, an end of the first sub-adsorber 121*a* at the refrigerant pipe REP may be connected to the evaporator 123 to receive the refrigerant evaporated by the evaporator 123 and adsorb the refrigerant, and an end of the second sub-adsorber 121*b* at the refrigerant pipe REP may be connected to the condenser 122 to transfer the refrigerant desorbed from the second sub-adsorber 121*b* to the condenser 122. That is, FIG. 2 shows a case where the first sub-adsorber 121*a* operates in an adsorption mode, and the second sub-adsorber 121*b* operates in a desorption mode.

In detail, for an adsorption mode to be smoothly performed in the first sub-adsorber 121*a*, the first sub-adsorber 121*a* needs to be maintained at an adsorption temperature. As described above, as the regeneration preheater 114 is maintained at a temperature of about 30° C. to about 40° C., when the regeneration preheater 114 supplies a heat transfer medium of about 30° C. to about 40° C. to the first sub-adsorber 121*a*, the first sub-adsorber 121*a* may be maintained at an adsorption temperature.

The heat transfer medium introduced into the first sub-adsorber 121*a* may be heated by adsorption heat generated in the first sub-adsorber 121*a* and may be heated to 40° C. to 50° C., and transferred to the regeneration preheater 114 to be used in preheating the air introduced into the regeneration passage RP.

For a desorption mode to be smoothly performed in the second sub-adsorber 121*b*, the second sub-adsorber 121*b* needs to be maintained at a desorption temperature. Here, the external heat source EHS refers to a heat transfer medium that may be supplied from the outside. For example, the external heat source EHS may include waste heat discharged from a power plant, or heat sources such as industrial waste heat or incineration heat, and renewable energy such as solar energy or geothermal energy. Most of the various examples of the external heat source EHS described above may be a low-temperature heat source of less than 100° C., and a heat transfer medium of about 70° C. to about 90° C. may flow into the second sub-adsorber 121*b*. That is, the second sub-adsorber 121*b* may be driven in a desorption mode by using the external heat source EHS.

Furthermore, a temperature of the heat transfer medium transferred from the external heat source EHS to the second sub-adsorber 121*b* may decrease as the heat transfer medium passes through the second sub-adsorber 121*b*. This is due to desorption (evaporation) of the refrigerant adsorbed to the second sub-adsorber 121*b*; as the refrigerant is desorbed, the refrigerant takes heat of the heat transfer medium passing through the second sub-adsorber 121*b*.

The temperature of the heat transfer medium that has decreased in the second sub-adsorber 121*b* is about 70° C., and the heat transfer medium having a temperature decreased in the second sub-adsorber 121*b* may be transferred to the heating coil 113 according to an opening direction of the third heat transfer medium valve 128 or to the external heat source EHS again. For example, when the third heat transfer medium valve 128 blocks the flow of a heat transfer medium flowing from the 2-2 heat transfer medium valve 127 to the external heat source EHS along the heat transfer medium pipe MP (see FIG. 2), that is, when the third heating transfer medium valve 128 allows a flow of the heat transfer medium flowing from the 2-2 heat transfer medium valve 127 to the heating coil 113, the heating coil 113 may be maintained at a temperature of about 70° C. via the heat transfer medium supplied from the second sub-adsorber 121*b* so as to heat the air passing through the heating coil 113. A regeneration efficiency of a portion of the desiccant rotor 112 passing through the regeneration passage RP may be increased by the air that is heated by passing through the heating coil 113.

On the other hand, when the third heat transfer medium valve 128 opens the flow of the heat transfer medium flowing from the 2-2 heat transfer medium valve 127 to the external heat source EHS along the heat transfer medium pipe MP (not shown), that is, when the third heat transfer medium valve 128 blocks the flow of the heat transfer medium flowing from the 2-2 heat transfer medium valve 127 to the heating coil 113, the heat transfer medium having a temperature that has decreased to some extent in the second sub-adsorber 121*b* may be transferred to the external heat source EHS again.

As another example, when the 1-1 heat transfer medium valve 124 connects the upstream end of the first sub-adsorber 121*a* at the heat transfer medium pipe MP to the external heat source EHS (see FIG. 3), the 1-2 heat transfer medium valve 125 may connect the downstream end of the first sub-adsorber 121*a* at the heat transfer medium pipe MP to the external heat source EHS, the 2-1 heat transfer medium valve 126 may connect the upstream end of the second sub-adsorber 121*b* at the heat transfer medium pipe MP to the regeneration preheater 114, and the 2-2 heat transfer medium valve 127 may connect the downstream end of the second sub-adsorber 121*b* at the heat transfer medium pipe MP to the regeneration preheater 114.

As illustrated in FIG. 3, when the external heat source EHS and the regeneration preheater 114 are respectively connected to the first sub-adsorber 121*a* and the second sub-adsorber 121*b*, an end of the first sub-adsorber 121*a* at the refrigerant pipeline REP may be connected to the condenser 122 to transfer the refrigerant desorbed from the first sub-adsorber 121*a* to the condenser 122, and an end of the second sub-adsorber 121*b* at the refrigerant pipeline REP may be connected to the evaporator 123 to receive the refrigerant evaporated in the evaporator 123 and adsorb the refrigerant. That is, FIG. 3 shows a case where the first sub-adsorber 121*a* operates in a desorption mode, and the second sub-adsorber 121*b* operates in an adsorption mode.

In detail, for a desorption mode to be smoothly performed in the first sub-adsorber 121*a*, the first sub-adsorber 121*a* needs to be maintained at a regeneration temperature. As described above, the external heat source EHS refers to a heat transfer medium that may be supplied from the outside. For example, the external heat source EHS may include waste heat discharged from a power plant, or heat sources such as industrial waste heat or incineration heat, and renewable energy such as solar energy or geothermal energy. Most of the various examples of the external heat source EHS described above may be a low-temperature heat source of less than 100° C., and a heat transfer medium of about 70° C. to about 90° C. may flow into the first sub-adsorber 121*a*. That is, the first sub-adsorber 121*a* may be driven in a desorption mode by using the external heat source EHS.

Furthermore, a temperature of the heat transfer medium transferred from the external heat source EHS to the first sub-adsorber 121*a* may be decreased as the heat transfer medium passes through the first sub-adsorber 121*a*. This is due to desorption (evaporation) of the refrigerant adsorbed to the first sub-adsorber 121*a*; as the refrigerant is desorbed, the refrigerant takes heat of the heat transfer medium passing through the first sub-adsorber 121*a*.

The temperature of the heat transfer medium that has decreased in the first sub-adsorber 121*a* is about 70° C., and the heat transfer medium having a temperature decreased in the first sub-adsorber 121*a* may be transferred again to the heating coil 113 or to the external heat source EHS again. Accordingly, when the third heat transfer medium valve 128 blocks the flow of a heat transfer medium flowing from the 1-2 heat transfer medium valve 125 to the external heat source EHS along the heat transfer medium pipe MP (not shown), that is, when the third heating transfer medium valve 128 allows a flow of the heat transfer medium flowing from the 1-2 heat transfer medium valve 125 to the heating coil 113, the heating coil 113 may be maintained at a temperature of about 70° C. via the heat transfer medium supplied from the second sub-adsorber 121*b* so as to heat the air passing through the heating coil 113. A regeneration efficiency of a portion of the desiccant rotor 112 passing through the regeneration passage RP may be increased by the air that is heated by passing through the heating coil 113.

On the other hand, when the third heat transfer medium valve 128 opens the flow of the heat transfer medium flowing from the 1-2 heat transfer medium valve 125 to the external heat source EHS along the heat transfer medium pipe MP (see FIG. 3), that is, when the third heat transfer medium valve 128 blocks the flow of the heat transfer medium flowing from the 1-2 heat transfer medium valve 125 to the heating coil 113, the heat transfer medium having a temperature that has decreased to some extent in the first sub-adsorber 121*a* may be transferred again to the external heat source EHS.

For an adsorption mode to be smoothly performed in the second sub-adsorber 121*b*, the second sub-adsorber 121*b* needs to be maintained at an adsorption temperature. As described above, as the regeneration preheater 114 is maintained at a temperature of about 30° C. to about 40° C., when the regeneration preheater 114 supplies a heat transfer medium of about 30° C. to about 40° C. to the second sub-adsorber 121*b*, the second sub-adsorber 121*b* may be maintained at an adsorption temperature.

The heat transfer medium introduced into the second sub-adsorber 121*b* may be heated by adsorption heat generated in the second sub-adsorber 121*b* to about 40° C. to about 50° C., and transferred again to the regeneration preheater 114 to be used in preheating the air introduced into the regeneration passage RP.

According to the above structure, power required to supply cool air to the air-conditioning space CS by using the adsorptive hybrid desiccant cooling system 100 according to the embodiment of the present disclosure may be transporting motive power of the fan 118, the first pump 129*a*, and the second pump 129*b*. As the fan 118, the first pump 129*a*, and the second pump 129*b* consume significantly less power than a compressor required for production of cool air in electric hybrid desiccant cooling systems of the related art, power consumption may be reduced compared to the electric hybrid desiccant cooling system of the related art.

In addition, according to the adsorptive hybrid desiccant cooling system 100 of the embodiment of the present disclosure, the external heat source EHS which is an energy source of the adsorptive cooler 120 is returned and reused to heat the heating coil 113 of the desiccant cooler 110. Thus, total heat energy input may be reduced as compared with the electric hybrid desiccant cooling system according to the related art.

According to the embodiment of the present disclosure as described above, the adsorptive hybrid desiccant cooling system may be implemented, whereby power consumption may be remarkably reduced by adding the adsorptive cooler driven by an external heat source, to the desiccant cooling system, and also, total energy efficiency may be greatly improved. However, the scope of the present disclosure is not limited by these effects.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims.

What is claimed is:

1. An adsorptive hybrid desiccant cooling system that includes an adsorptive cooler producing cool air by using an external heat source, the adsorptive hybrid desiccant cooling system comprising:

a desiccant cooler comprising a housing including a regeneration passage and a dehumidification passage through which air passes, a desiccant rotor installed inside the housing to be rotatable about a rotary shaft mounted on a partition wall dividing the regeneration passage and the dehumidification passage from each other, a regeneration preheater installed upstream of the desiccant rotor in the regeneration passage, and a cooler installed downstream of the desiccant rotor in the dehumidification passage; and the adsorptive cooler comprising an adsorber including a first sub-adsorber and a second sub-adsorber configured to adsorb a refrigerant at an adsorption temperature and desorb the refrigerant at a regeneration temperature, a condenser configured to condense the refrigerant that is desorbed from the adsorber and is in a gaseous state so as to provide heating by using condensation heat, and an evaporator configured to evaporate the refrigerant and transfer the refrigerant in a gaseous state to the adsorber and produce the cool air by using evaporation heat, wherein the adsorber is connected to each of the external heat source and the regeneration preheater, and wherein the regeneration preheater is heated by adsorption heat generated in the adsorber.

2. The adsorptive hybrid desiccant cooling system of claim 1, further comprising a heating coil between the regeneration preheater and the desiccant rotor in the regeneration passage, the heating coil being heated by the external heat source, a heat of the external heat source having a temperature decreased by passing through the adsorber.

3. The adsorptive hybrid desiccant cooling system of claim 2, wherein air introduced into the regeneration passage is heated by sequentially passing through the regeneration preheater and the heating coil, and the heated air regenerates the desiccant rotor passing through the regeneration passage.

4. The adsorptive hybrid desiccant cooling system of claim 1, wherein air introduced into the dehumidification passage is dehumidified by passing through the desiccant rotor in the dehumidification passage, and the dehumidified air is cooled by passing through the cooler.

5. The adsorptive hybrid desiccant cooling system of claim 4, wherein the desiccant cooler further comprises a re-cooler that is connected to the evaporator of the adsorptive cooler and installed downstream of the cooler in the dehumidification passage to re-cool the air that is cooled by passing through the cooler.

6. The adsorptive hybrid desiccant cooling system of claim 1, wherein the cooler comprises a regenerative evaporative cooler.

7. The adsorptive hybrid desiccant cooling system of claim 1, wherein the adsorptive cooler further comprises a plurality of refrigerant pipes respectively connecting the first sub-adsorber and the second sub-adsorber to the condenser and the evaporator, and a refrigerant flowing in the plurality of refrigerant pipes sequentially circulates through the first sub-adsorber, the condenser, the evaporator, and the second sub-adsorber, or through the second sub-adsorber, the condenser, the evaporator, and the first sub-adsorber.

8. The adsorptive hybrid desiccant cooling system of claim 7, wherein the adsorptive cooler further comprises:

a first refrigerant valve installed in a first refrigerant pipe of the plurality of refrigerant pipes connecting the first sub-adsorber to the condenser and the evaporator;

a second refrigerant valve installed in a second refrigerant pipe of the plurality of refrigerant pipes connecting the second sub-adsorber to the condenser and the evaporator; and a third refrigerant valve installed in a third refrigerant pipe connecting the condenser and the evaporator.

9. The adsorptive hybrid desiccant cooling system of claim 7, wherein the adsorptive cooler comprises:

a heat transfer medium pipe including a first heat transfer medium pipe connecting the regeneration preheater to the first sub-adsorber and the second sub-adsorber; and a second heat transfer medium pipe connecting the external heat source to the first sub-adsorber and the second sub-adsorber.

10. The adsorptive hybrid desiccant cooling system of claim 9, wherein the adsorptive cooler comprises:

a first heat transfer medium valve that is installed at an upstream end of the first sub-adsorber so as to connect one of the external heat source or the regeneration preheater to the upstream end of the first sub-adsorber;

a second heat transfer medium valve that is installed at a downstream end of the first sub-adsorber so as to connect the downstream end of the first sub-adsorber to the one of the external heat source or the regeneration preheater;

a third heat transfer medium valve that is installed at an upstream end of the second sub-adsorber so as to connect the one of the external heat source or the regeneration preheater to the upstream end of the second sub-adsorber; and a fourth heat transfer medium valve that is installed at a downstream end of the second sub-adsorber so as to connect the downstream end of the second sub-adsorber to the one of the external heat source or the regeneration preheater.

11. The adsorptive hybrid desiccant cooling system of claim 10, wherein the first heat transfer medium valve is installed at the upstream end of the first sub-adsorber, where the first heat transfer medium pipe and the second heat transfer medium pipe intersect with each other, the second heat transfer medium valve is installed at the downstream end of the first sub-adsorber, where the first heat transfer medium pipe and the second heat transfer medium pipe are divided from each other, the third heat transfer medium valve is installed at the upstream end of the second sub-adsorber, where the first heat transfer medium pipe and the second heat transfer medium pipe intersect with each other, and the fourth heat transfer medium valve is installed at the downstream end of the second sub-adsorber, where the first heat transfer medium pipe and the second heat transfer medium pipe are divided from each other.

12. The adsorptive hybrid desiccant cooling system of claim 10, wherein the first heat transfer medium valve connects the upstream end of the first sub-adsorber to the regeneration preheater, the second heat transfer medium valve connects the downstream end of the first sub-adsorber to the regeneration preheater, the third heat transfer medium valve connects the upstream end of the second sub-adsorber to the external heat source, and the fourth heat transfer medium valve connects the downstream end of the second sub-adsorber to the external heat source.

13. The adsorptive hybrid desiccant cooling system of claim 12, wherein an end of the first sub-adsorber at the first refrigerant pipe is connected to the evaporator to receive the refrigerant evaporated in the evaporator to adsorb the refrigerant, and wherein an end of the second sub-adsorber at the second refrigerant pipe is connected to the condenser to transfer the refrigerant desorbed from the second sub-adsorber to the condenser.

14. The adsorptive hybrid desiccant cooling system of claim 10, wherein the first heat transfer medium valve connects the upstream end of the first sub-adsorber to the external heat source, the second heat transfer medium valve connects the downstream end of the first sub-adsorber to the external heat source, the third heat transfer medium valve connects the upstream end of the second sub-adsorber to the regeneration preheater, and the fourth heat transfer medium valve connects the downstream end of the second sub-adsorber to the regeneration preheater.

15. The adsorptive hybrid desiccant cooling system of claim 14, wherein an end of the first sub-adsorber at the first refrigerant pipe is connected to the condenser to transfer the refrigerant desorbed from the first sub-adsorber to the condenser, and wherein an end of the second sub-adsorber at the second refrigerant pipe is connected to the evaporator to receive the refrigerant evaporated in the evaporator to adsorb the refrigerant.

16. The adsorptive hybrid desiccant cooling system of claim 9, wherein the adsorptive cooler further comprises a heat transfer medium valve that is installed at a downstream end of the first sub-adsorber and the second sub-adsorber so as to connect the downstream end of the first sub-adsorber and the second sub-adsorber to one of the external heat source or the heating coil.

17. The adsorptive hybrid desiccant cooling system of claim 1, wherein the adsorptive cooler further comprises a first pump installed between the external heat source and the adsorber to guide heat from the external heat source to the adsorber.

18. The adsorptive hybrid desiccant cooling system of claim 1, wherein the adsorptive cooler further comprises a second pump installed between the regeneration preheater and the adsorber to guide a heat transfer medium of the regeneration preheater to the adsorber.

* * * * *